US009132666B2

(12) United States Patent
Lo et al.

(10) Patent No.: US 9,132,666 B2
(45) Date of Patent: Sep. 15, 2015

(54) CURL CONTROL ASSEMBLIES

(75) Inventors: Kevin Lo, Vancouver, WA (US); David Whalen, Vancouver, WA (US); Raymond C. Sherman, Camas, WA (US); Terry Lingmann, Oregon City, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/370,625

(22) PCT Filed: Jan. 24, 2012

(86) PCT No.: PCT/US2012/022447

§ 371 (c)(1),
(2), (4) Date: Jul. 3, 2014

(87) PCT Pub. No.: WO2013/112140

PCT Pub. Date: Aug. 1, 2013

(65) Prior Publication Data

US 2015/0001790 A1 Jan. 1, 2015

(51) Int. Cl.
*B65H 29/00* (2006.01)
*B41J 11/00* (2006.01)
(Continued)

(52) U.S. Cl.
CPC ..... *B41J 11/0005* (2013.01); *B41J 13/106* (2013.01); *B65H 7/20* (2013.01);
(Continued)

(58) Field of Classification Search
CPC ..... B65H 29/00; B65H 29/52; B65H 29/70; B65H 31/00; B65H 2404/50; B65H 2404/51; B65H 2404/62; B65H 2404/623; B65H 2404/63; B65H 2407/30
USPC ..... 271/176, 188, 209
See application file for complete search history.

(56) References Cited

U.S. PATENT DOCUMENTS 4,340,213 A 7/1982 Jensen
4,789,150 A 12/1988 Plain
(Continued)

FOREIGN PATENT DOCUMENTS

CN 1572693 A 2/2005
CN 1962265 A 5/2007
(Continued)

OTHER PUBLICATIONS

Grotta, S.W. et al. Epson Artisan 837 Review and Ratings. http://computershopper.com/printers/reviews/epson-artisan-837.
(Continued)

*Primary Examiner* — David H Bollinger
(74) *Attorney, Agent, or Firm* — Hewlett-Packard Patent Department

(57) ABSTRACT

Examples disclosed herein relate to curl control assembly for use in a printing device having an output for printed media. One such example includes an ejection flap assembly adjacent the output configured to controllably assume a first predetermined position designed to help control a first amount of curl of the printed media and a second predetermined position designed to help control a second amount of curl of the printed media. The example additionally includes a positioning assembly adjacent the ejection flap assembly configured to selectively position the ejection flap assembly in either the first predetermined position or the second predetermined position and an actuator coupled to the positioning assembly that has a latched state that helps prevent movement of the positioning assembly and an unlatched state that permits movement of the positioning assembly. An example of a curl control method for use in a printing device is additionally disclosed.

23 Claims, 10 Drawing Sheets

(51) Int. Cl.

| | |
|---|---|
| ***B41J 13/10*** | (2006.01) |
| ***B65H 7/20*** | (2006.01) |
| ***B65H 29/52*** | (2006.01) |
| ***B65H 29/70*** | (2006.01) |
| ***B65H 31/26*** | (2006.01) |
| ***B65H 31/34*** | (2006.01) |

(52) U.S. Cl.

CPC ..... *B65H 29/00* (2013.01); *B65H 29/52* (2013.01); *B65H 29/70* (2013.01); *B65H 31/26* (2013.01); *B65H 31/34* (2013.01); *B65H 2301/51256* (2013.01); *B65H 2404/63* (2013.01); *B65H 2511/214* (2013.01); *B65H 2701/1315* (2013.01); *B65H 2801/06* (2013.01)

(56) References Cited

U.S. PATENT DOCUMENTS

| | | | | |
|---|---|---|---|---|
| 5,761,600 | A | 6/1998 | Murata | |
| 7,352,382 | B2 | 4/2008 | Arai | |
| 7,762,543 | B2 | 7/2010 | Matsushima | |
| 7,980,544 | B2 | 7/2011 | Baba et al. | |
| 8,567,780 | B2 * | 10/2013 | Yoshida | 271/306 |
| 8,602,413 | B2 | 12/2013 | St. Ours et al. | |
| 2004/0251608 | A1 | 12/2004 | Saito et al. | |
| 2007/0063412 | A1 | 3/2007 | Terao et al. | |
| 2008/0175638 | A1 | 7/2008 | Murayama | |
| 2009/0245905 | A1 | 10/2009 | Matsushima | |
| 2010/0078871 | A1 | 4/2010 | Uchino et al. | |
| 2011/0062657 | A1 | 3/2011 | Williams | |
| 2013/0140765 | A1 * | 6/2013 | Mizubata et al. | 271/254 |

FOREIGN PATENT DOCUMENTS

| | | |
|---|---|---|
| CN | 101007603 | 8/2007 |
| CN | 101497408 | 8/2009 |
| JP | 2011057448 | 3/2001 |
| JP | 2008120494 | 5/2008 |

OTHER PUBLICATIONS

International Search Report Date of Mailing Oct. 19, 2012. PCT/US2012/022447 Filed date Jan. 24, 2012.

* cited by examiner

CURL CONTROL ASSEMBLIES

BACKGROUND

A challenge exists to deliver quality and value to consumer, for example, by providing reliable printing devices that are cost effective. Further, businesses may desire to enhance the performance of their printing devices, for example, by increasing the reliability and output quality of such printing devices.

BRIEF DESCRIPTION OF THE DRAWINGS

The following detailed description references the drawings, wherein.

DETAILED DESCRIPTION

Figure 1:
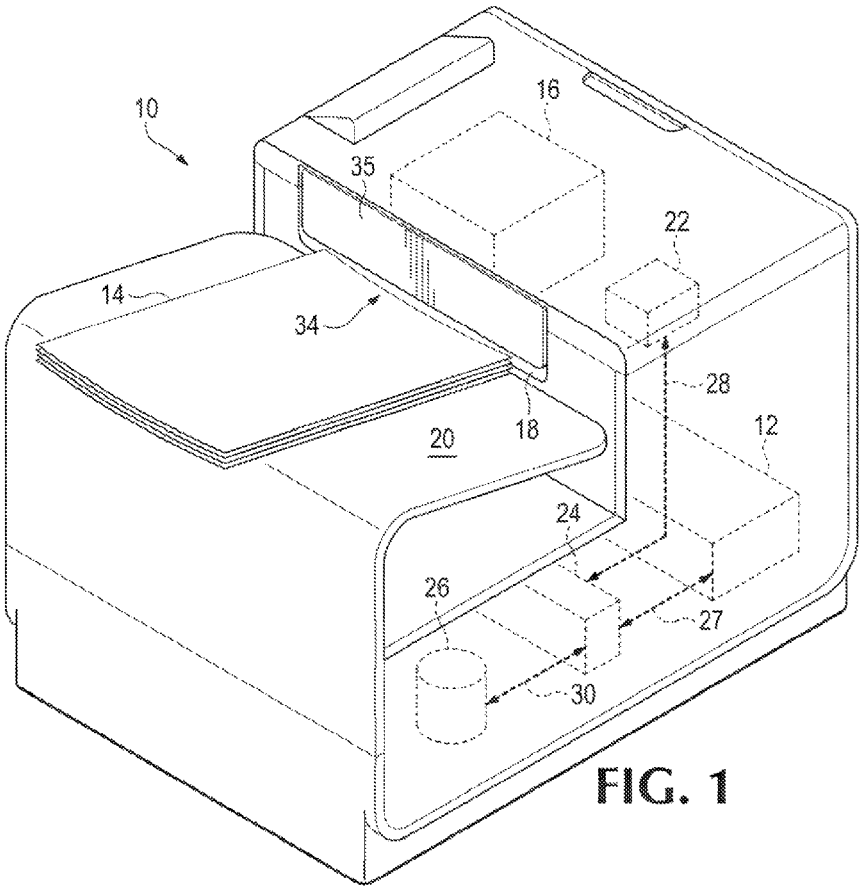
FIG. 1 is a perspective view of an example of a printing device.

A perspective view of an example of a printing device 10 is shown in FIG. 1. Printing device 10 includes a printing assembly (generally indicated by block 12) configured to place images (e.g., text, graphics, pictures, photos, etc.) on print media 14. In the example of printing device 10 shown in FIG. 1, printing assembly 12 uses ink-jet technology to form images on print media 14. In other examples, however, different printing technologies may be used such as laser-jet, liquid electro-photographic, dye sublimation, etc. Printing device 10 also includes a transport assembly (diagrammatically indicated by block 16) configured to move print media 14 from printing assembly 12 to an output 18 where it collects on tray 20 (as shown) for retrieval by end users. Printing device 10 additionally includes a curl control assembly (diagrammatically indicated by block 22) adjacent output 18 and configured to selectively contact print media 14 at a predetermined position as the print media travels through output 18, as discussed more fully below.

Printing device 10 further includes a processor (diagrammatically indicated by block 24) and a non-transitory computer-readable storage medium (diagrammatically indicated by block 26). Processor 24 is coupled to curl control assembly 22, as generally indicated by double-arrow 28, printing assembly 12, as generally indicated by double-arrow 27, transport assembly 16, and non-transitory computer-readable storage medium 26, as generally indicated by double-arrow 30. Processor 24 is configured to determine an amount of curl of print media 14 and adjust curl control assembly 22 to contact print media 14 at the predetermined position based on the determined amount of curl of print media 14. Non-transitory computer-readable storage medium 26 stores instructions that, when executed by processor 24, cause processor 24 to determine the amount of curl of print media 14 and adjust curl control assembly 22 to contact print media 14 at the predetermined position based on the determined amount of curl of print media 14.

Figure 2:
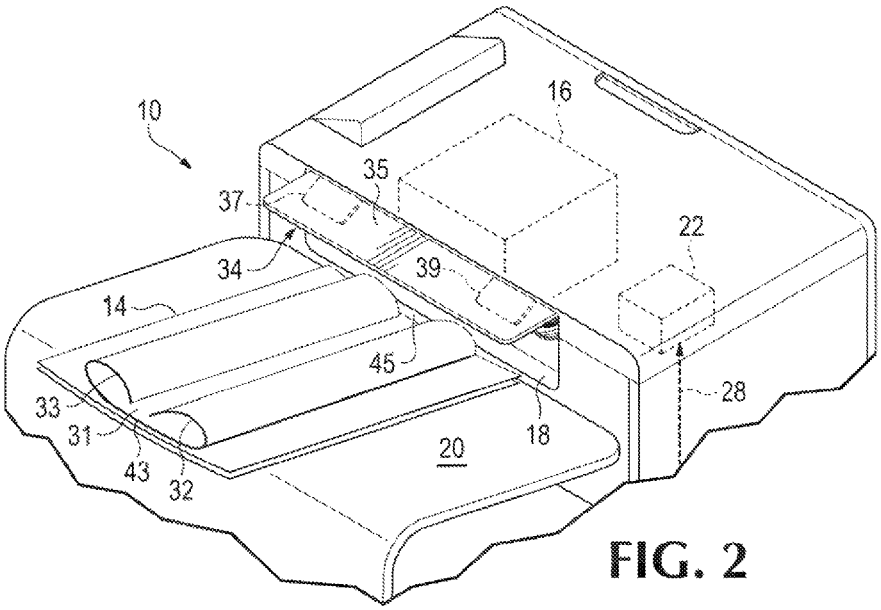
FIG. 2 is a perspective view of a fragmented portion of the printing device of FIG. 1.

A perspective view of a fragmented portion of printing device 10 is shown in FIG. 2. FIG. 2 illustrates a print medium sheet 31 in tray 20 where edges 32 and 33 have curled. This curling can happen for a variety of reasons, such as the type of print media, ambient temperature, ambient humidity, the amount of printing composition on print medium 31, etc. Additionally, other parts of print medium 31 may curl as well as edges 32 and 33 or instead of edges 32 and 33, such as edge 43 or edge 45. Furthermore, sometimes only one of edges 32, 33, 43 or 45 may curl. Such curl, it not corrected, may not only damage print medium 31, but might also jam or clog output or exit 18 which may led to other damaged print media and inoperability of printing, device 10.

Figure 3:
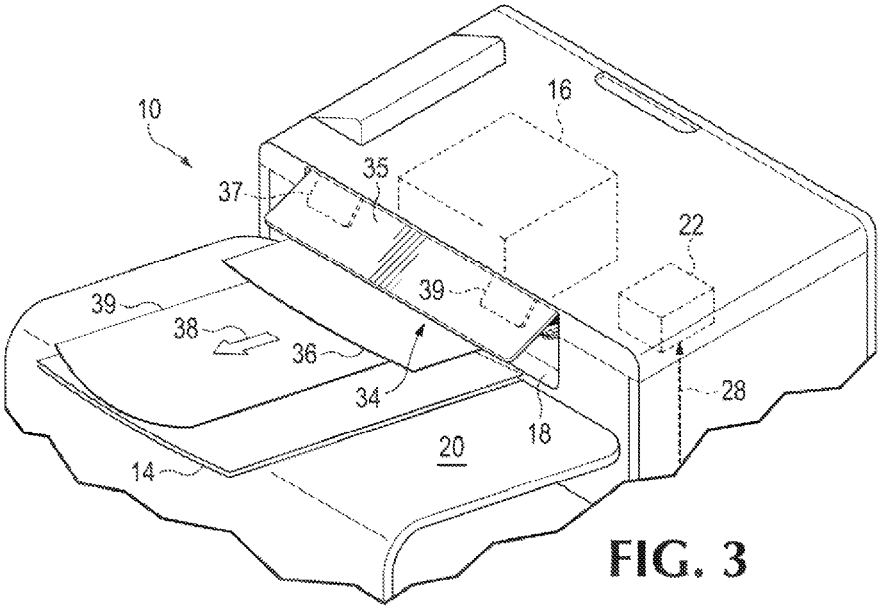
FIG. 3 is another perspective view of a fragmented portion of the printing device of FIG. 1.

Another perspective view of the fragmented portion of printing device 10 of FIG. 2 is shown in FIG. 3. As can be seen in FIG. 3, curl control assembly 22 includes an ejection flap assembly 34 adjacent output 18 of printing device 10. Ejection flap assembly 34 includes a main flap 35 and a pair of mini-flaps 37 and 39 coupled to main flap 35. Mini-flaps 35 and 37 are configured to depend from main flap 35 as main flap 35 is raised. As discussed more fully below, ejection flap assembly 34 is configured to controllably assume at least a first predetermined position designed to help control a first amount of curl of printed media 14 as it exits output 18 of printing device 10 and a second predetermined position designed to help control a second amount of curl of printed media 14 as printed media 14 exits output 18 of printing device 10.

As can also be seen in FIG. 3, ejection flap assembly 34 is configured to selectively contact print medium 36 at one of these predetermined positions as it travels through output 18 in the direction generally indicated by arrow 38. This contact helps alleviate curl of print medium 36 that might otherwise occur, as generally shown by the reduced curl of print medium 39 which will flatten once print medium 36 is deposited on top of it. Additionally mini-flaps 37 and 39 of ejection flap assembly 34 help prevent the trailing edge of print medium 36 from curling when main flap 35 is too far forward to do so. Mini-flaps 37 and 39 additionally act as vibrators or tampers, as they fall onto the print media after each sheet goes by, thereby gently tamping these sheets down into a neater stack on tray 20.

Figure 4:
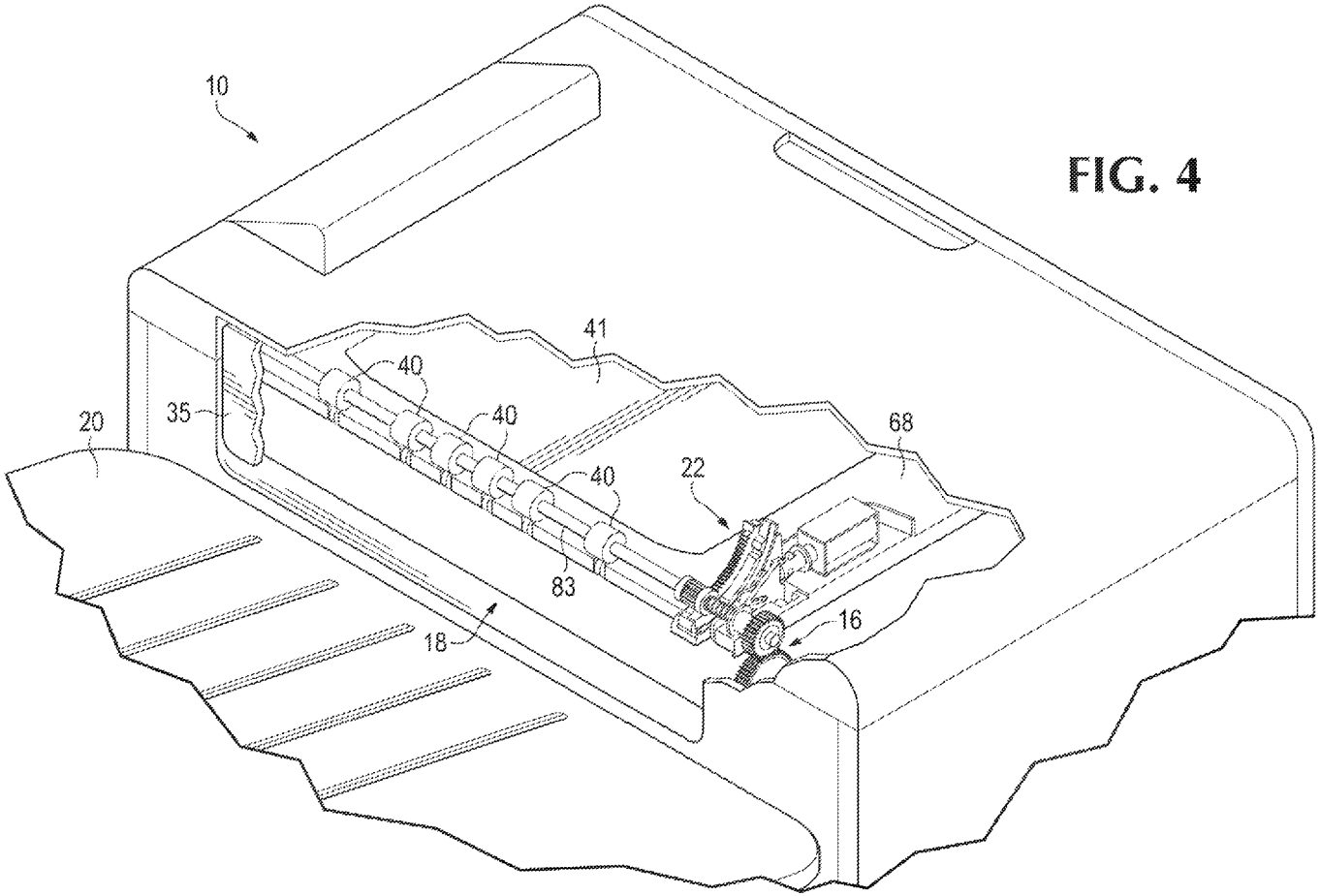
FIG. 4 is an enlarged perspective view of an internal portion of the printing device of FIG. 1.

An enlarged perspective view of an internal portion of printing device 10 is shown in FIG. 4. The illustrated interior portion of printing device 10 shows part of transport assembly 16 and curl control assembly 22. As can be seen in FIG. 4 and discussed in more detail below, transport assembly 16 is coupled to curl control assembly 22 and is configured to drive curl control assembly 22. This arrangement helps reduce cost by using one motor to drive both curl control assembly 22 and media drive output rollers 40 rather than two separate motors.

Figure 5:
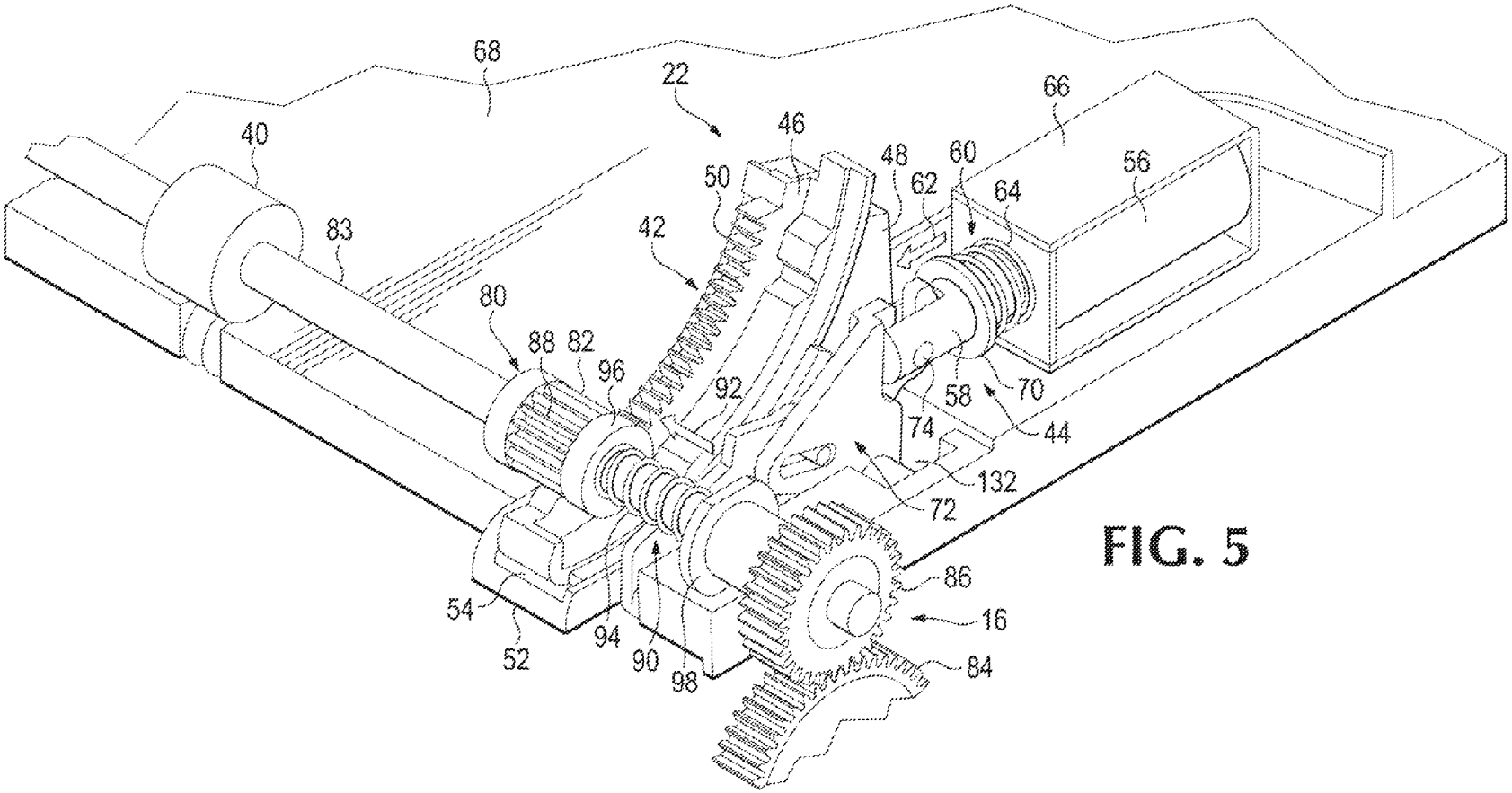
FIG. 5 is an enlarged perspective view of an example of a curl control assembly.

An enlarged perspective view of curl control assembly 22 and a portion of transport assembly 16 are shown in FIG. 5. As can be seen in FIG. 5, curl control assembly 22 includes a positioning assembly 42 that is placed adjacent ejection flap assembly 34 (not shown in FIG. 5). Positioning assembly 42 is configured to selectively position ejection flap assembly 34 in various predetermined positions, as discussed in more detail below, for example, in connection with FIGS. 7-10. Curl control assembly 22 additionally includes an actuator or catch assembly 44 coupled to positioning assembly 42. Actuator or catch assembly 44 is configured to have both a latched state that locks or helps prevent movement of positioning assembly 42 and an unlatched state that permits movement of positioning assembly 42, as also discussed in more detail below, be example, in connection with FIGS. 7-10.

As can also be seen in FIG. 5, positioning assembly 42 includes a gear mechanism or driven gear 46 and a support or base 48. In the illustrated example, gear mechanism or driven gear 46 is configured to have a crescent-shape and to include a plurality of teeth 50 of a predetermined pitch. Base or support 48 of positioning assembly 42 is configured in a general shape of a ramp or sled 52 that includes a track or groove 54 in which gear mechanism or driven gear 46 is slidably disposed. As can additionally be seen in the example of curl control assembly 22 shown in FIG. 5, actuator or catch assembly 44 includes a linear operating device 56 (e.g., a solenoid) and a biased shaft or rod 58. In this example, bias is applied to shaft or rod 58 via biasing assembly 60 in a direction indicated by arrow 62. In this example, biasing assembly 60 includes a spring 64 which is disposed around shaft or rod 58. Spring 64 pushes against case or housing 66 around linear operating device 56 which is attached to output platen 68 and also against collar or plate 70 which is attached to shaft or rod 58. Actuator or catch assembly 44 additionally includes a linkage mechanism 72 that is coupled to gear mechanism or driven gear 46 and attached to shaft or rod 58 via a pin 74 disposed in slot or recess 76 (see FIG. 6) famed in first member 78 of linkage mechanism 72.

Referring attain to FIG. 5 and as discussed above, transport assembly 16 is coupled to curl control assembly 22 and is configured to drive curl control assembly 22. As can further be seen in the example shown in FIG. 5, transport assembly 16 accomplishes this via a clutch assembly 80. Clutch assembly 80 includes drive gear 82 disposed on shaft or rod 83 of transport assembly 16 so as to rotate therewith when driven by gears 84 and 86 of transport assembly 16. Drive gear 82 includes a plurality of teeth 88 of predetermined pitch that mesh with teeth 50 of driven gear 46. Clutch assembly 80 additionally includes it biasing assembly 90 that is configured to apply a biasing force to drive gear 82 in a direction indicated by arrow 92. In this example, biasing assembly 90 includes a spring 94 which is disposed around shaft or rod 83. Spring 94 pushes against side 96 of drive gear 82 and also against collar or plate 98 which is attached to shaft or rod 83. In this example, clutch assembly 80 is a slip/friction clutch where biasing assembly 90 maintains a substantially constant force against drive gear 82 which, in turn, allows drive gear 82 to transmit a certain amount of torque. When this torque is exceeded after driven gear 46 reaches its end of travel, clutch assembly 80 will slip with respect to shaft or rod 83. This allows shall or rod 83 and rollers 40 to continue moving media toward output 18.

Figure 6:
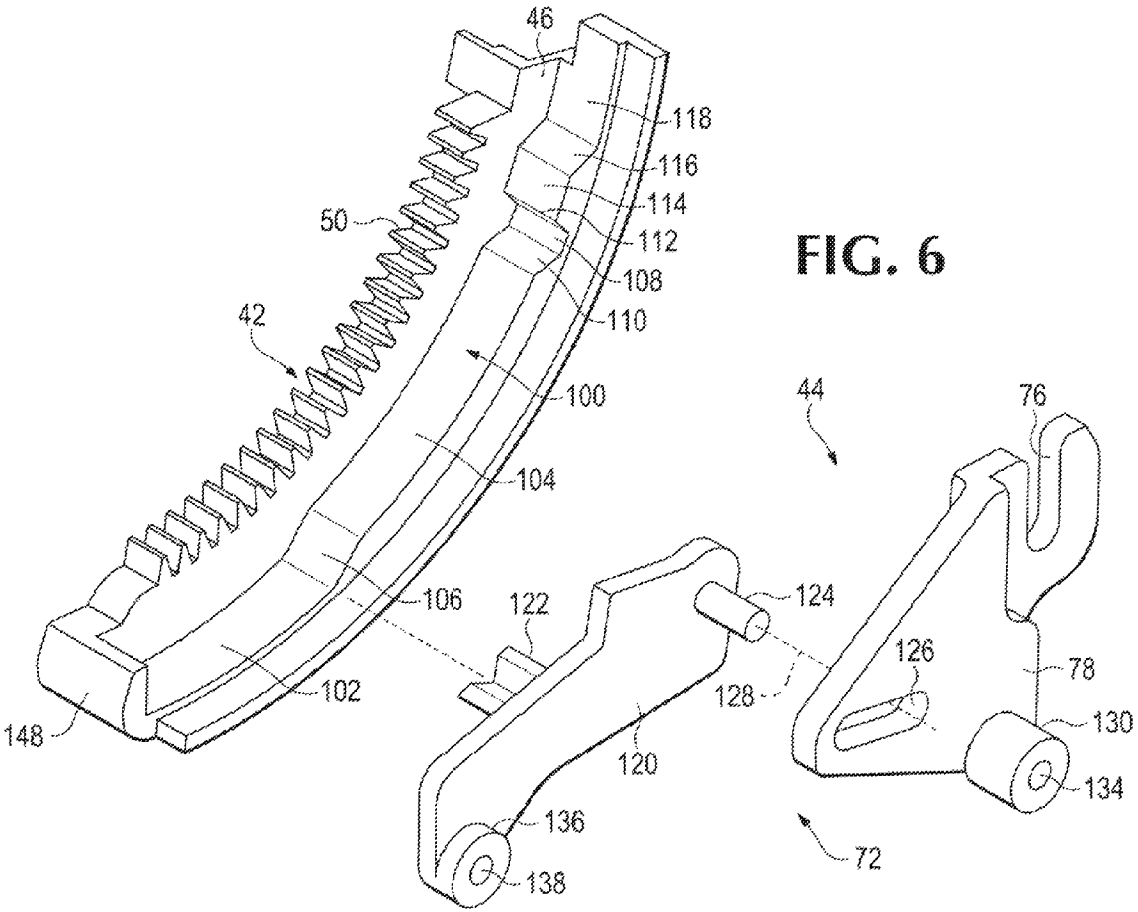
FIG. 6 is an enlarged, exploded perspective view of an example of some of the components of the curl control assembly of FIG. 5.

An enlarged, exploded, perspective view of some of the components of positioning assembly 42 and actuator or catch assembly 44 is shown in FIG. 6. As can be seen in FIG. 6, gear mechanism 46 of positioning assembly 42 is configured to include a profiled region 100 that includes several attributes. More specifically, profiled region 100 includes a base area or surface 102 and an adjoining relatively higher raised area or surface 104. A ramp 106 provides a transition between base area or surface 102 and raised area or surface 104. Profiled region 100 additionally includes a recessed area or surface 108 defined an either side by ramps 110 and 112. Ramp 110 is configured to provide a transition between raised area or surface 104 and recessed area or surface 108. Ramp 112 is configured to provide a transition between recessed area or surface 108 and raised area or surface 114. Profiled region 100 is further includes a ramp 116 that is configured to provide a transition between raised area or surface 114 and area or surface 118.

As can also be seen in FIG. 6, linkage mechanism 72 includes a second member 120 in addition to first member 78. Second member 120 is configure to include a follower 122 (in this example having a V-shape) that is designed to ride along profiled region 100, as discussed in more detail below in connection with FIGS. 7-10. Second member 120 is additionally configured to include a pin 124 positioned within slot 126 formed in first member 78, as generally indicated by dashed line 128. Pin 124 is designed to translate within slot 126, as also discussed in more detail below in connection with FIG. 7-10. As can additionally be seen in FIG. 6, first member 78 of linkage mechanism 72 is configured to include a boss 130 that is disposable within cavity 132 of output platen 68 as shown in FIG. 5. Referring again to FIG. 6, boss 130 is configured to define an opening 134 in which a pin (not shown) may be disposed to rotatably secure first member 78 with in cavity 132 of output platen 68. As can further be seen in FIG. 6, second member 120 of linkage mechanism 72 includes a boss 136 which is configured to define an opening 138 in which a pin (also not shown) may be disposed to rotatably secure second member 120 to output platen 68.

Figure 7:
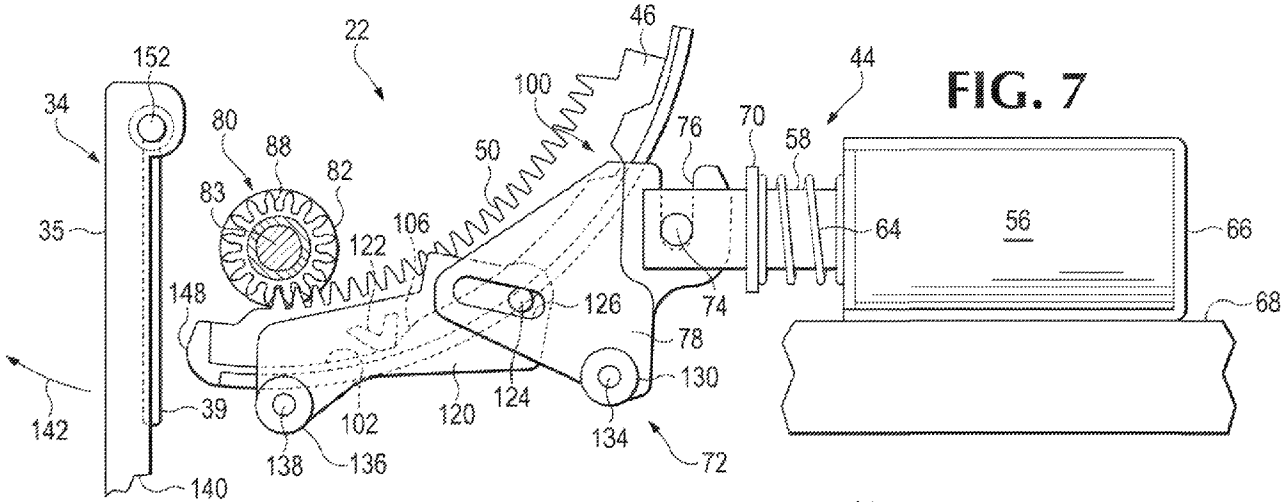
FIGS. 7-10 provide examples of the operation of a curl control assembly.
Figure 8:
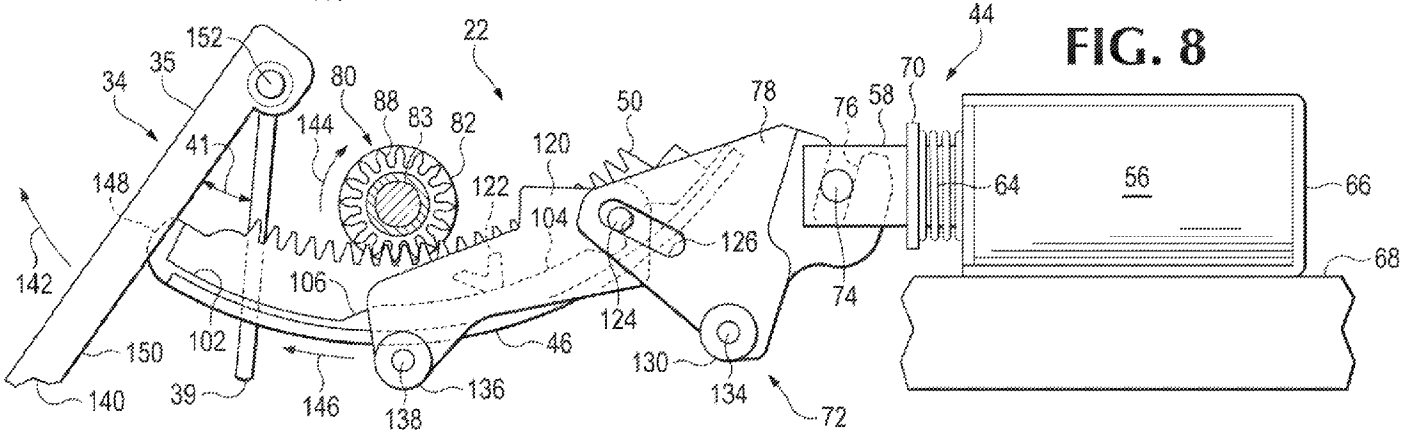
Figure 9:
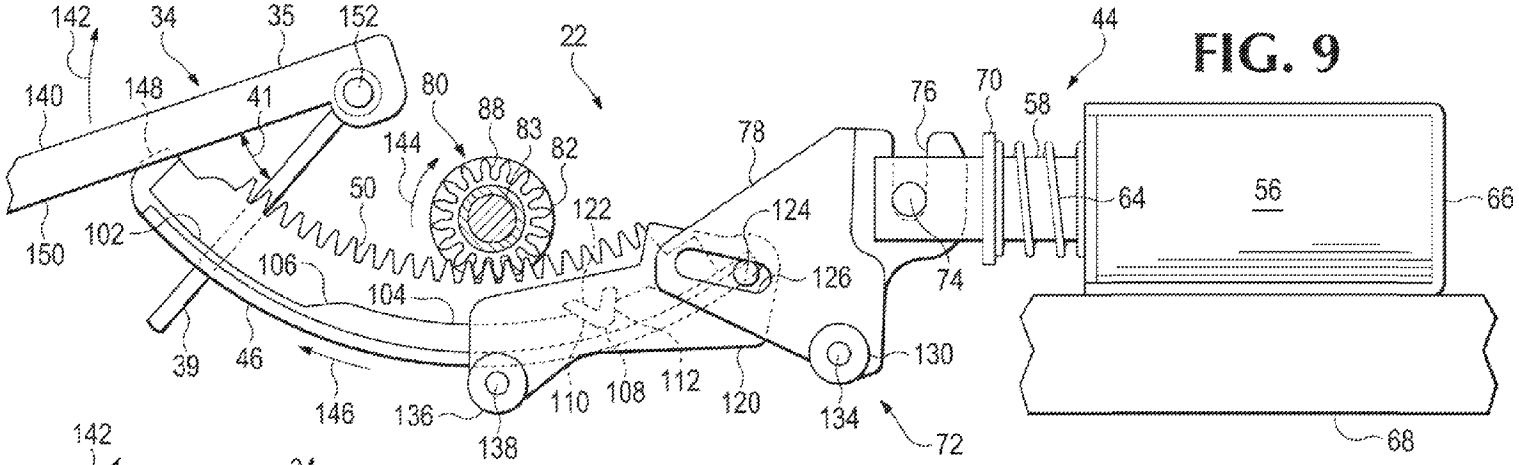
Figure 10:
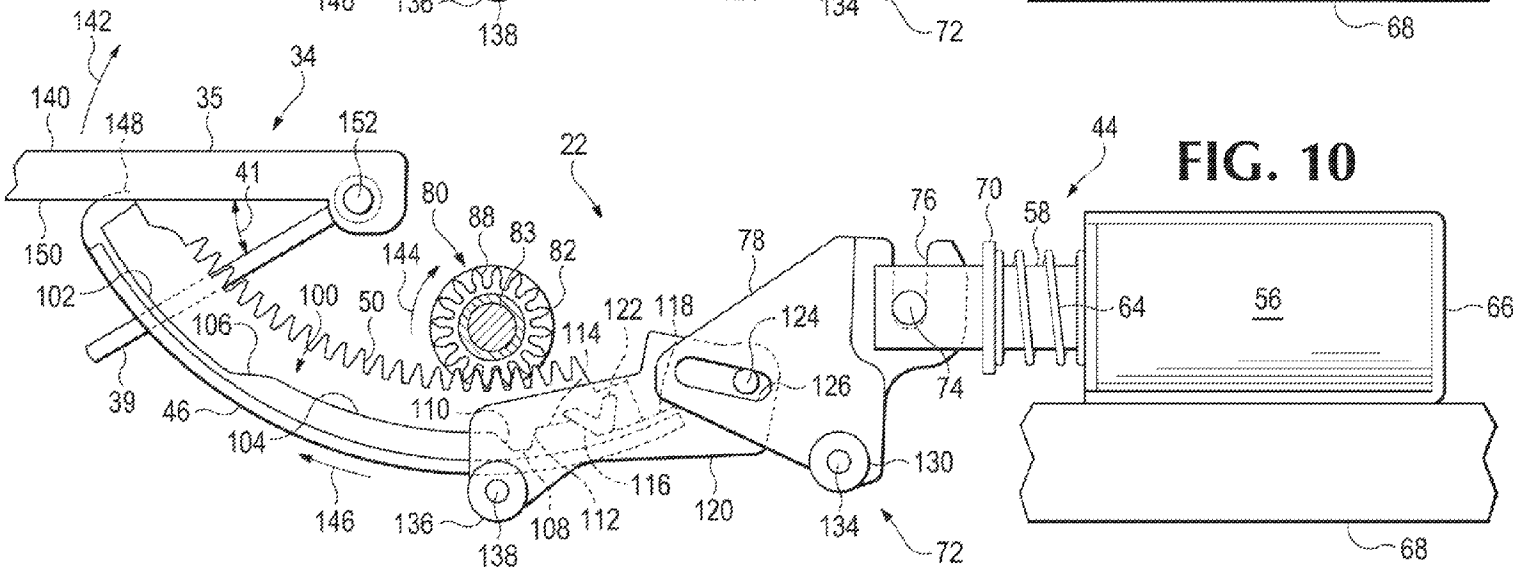

An example of the operation of curl control assembly 22 is shown in FIGS. 7-10. Specifically, FIG. 7 illustrates a possible initial position in which curl control assembly 22 is unengaged from ejection flap assembly 34. As can be seen in FIG. 7, main flap 35 or ejection flap assembly 34 includes a hinged door 140 that is configured to deflect through an arc 142, as illustrated in FIGS. 8-10. As can also be seen in FIG. 7, follower 122 is positioned on base area or surface 102 and lies adjacent ramp 106.

As can be seen in FIG. 8, linear operating device 56 of actuator 44 may be activated, by, for example, processor 24 based on instructions from non-transitory computer-readable storage medium 26, to move shaft or rod 58 which compresses spring 64, as shown. This movement causes first member 78 to pivot about boss 130 which moves pin 124 in slot 126. This in turn causes second member 120 to lift follower 122 to an unlatched or unlocked position. Rotation of drive gear 82 of transport assembly 16 in the direction indicated by arrow 144 causes gear mechanism 46 to move in the direction indicated by arrow 146. This in turn causes end 148 of gear mechanism or driven gear 46 to push against surface 150 of main flap 35 of ejection flap assembly 34 which pivots about hinge 152 to the first curl control position shown. Mini-flaps 37 (not shown) and 39 also swing down so that they depend from main flap 35 at a predetermined angle, as indicated by double-arrow 41. In the example shown, this predetermined angle is approximately thirty degrees (30°). This predetermined angle may differ in other examples, however. Movement of gear mechanism 46 in the direction indicated by arrow 146 additionally causes lifted follower 122 to travel up ramp from base area or surface 102 to raised area or surface 104.

As can be seen in FIG. 9, continued rotation of drive gear 82 of transport assembly 16 in the direction indicated by arrow 144 causes gear mechanism 46 to continue to move in the direction indicated by arrow 146. This in turn causes end 148 of gear mechanism or driven gear 46 to further push against surface 150 of main flap 35 of ejection flap assembly 34 which pivots about hinge 152 to the second curl control position shown. This further movement of gear mechanism 46 in the direction indicated by arrow 146 causes lifted follower 122 to travel along raised area or surface 104 until it eventually resides in recessed area or surface 108 via ramp 110. In this position, linear operating device 56 of actuator 44 may be deactivated to release shaft or rod 58 which causes spring 64 to decompress, as shown. This movement causes first member 78 to pivot about boss 130 which moves pin 124 in slot 126 which causes second member 120 to pivot about boss 136, as shown.

Linear operating device 56 of actuator 44 may again be activated to move shaft or rod 58 which compresses spring 64. This movement causes first member 78 to pivot about boss 130 which moves pin 124 in slot 126. This in turn causes second member 120 to lift follower 122 to an unlatched or unlocked position. Rotation of drive gear 82 of transport assembly 16 in the direction indicated by arrow 144 causes gear mechanism 46 to further move in the direction indicated by arrow 146. This in turn causes end 148 of gear mechanism or driven gear 46 to push against surface 150 of main flap 35 of ejection flap assembly 34 which pivots about hinge 152. Movement of gear mechanism 46 in the direction indicated by arrow 146 additionally causes lifted follower 122 to travel out of recessed area or surface 108, up ramp 112 to raised area or surface 114.

Continued rotation of drive gear 82 of transport assembly 16 in the direction indicated by arrow 144 causes gear mechanism 46 to continue to move in the direction indicated by arrow 146. This in turn causes end 148 of gear mechanism or driven gear 46 to further push against surface 150 of main flap 35 of ejection flap assembly 34 which pivots about hinge 152 to the fully open position shown in FIG. 10. This further movement of gear mechanism 46 in the direction indicated by arrow 146 causes lifted follower 122 to travel along raised area or surface 114 until it eventually resides on area or surface 118 via ramp 116. In this position, linear operating device 56 of actuator 44 may be deactivated to release shaft or rod 58 which causes spring 64 to decompress. This movement causes first member 78 to pivot about boss 130 which moves pin 124 in slot 126 which causes second member 120 to pivot about boss 136.

Ejection flap assembly 34 may be lowered or repositioned as well as raised. For example, linear operating device 56 of actuator 44 may again be activated to move shaft or rod 58 which compresses spring 64. This movement causes first member 78 to pivot about boss 130 which moves pin 124 in slot 126. This in turn causes second member 120 to lift follower 122 to an unlatched or unlocked position. Rotation of drive gear 82 of transport assembly 16 in a direction opposite that indicated by arrow 144 causes gear mechanism 46 to move in the direction opposite that indicated by arrow 146. This in turn moves end 148 of gear mechanism or driven gear 46 away from surface 150 of main flap 35 of ejection flap assembly 34 which causes it to pivot about hinge 152 in a direction opposite that indicated by arc 146.

Figure 11:
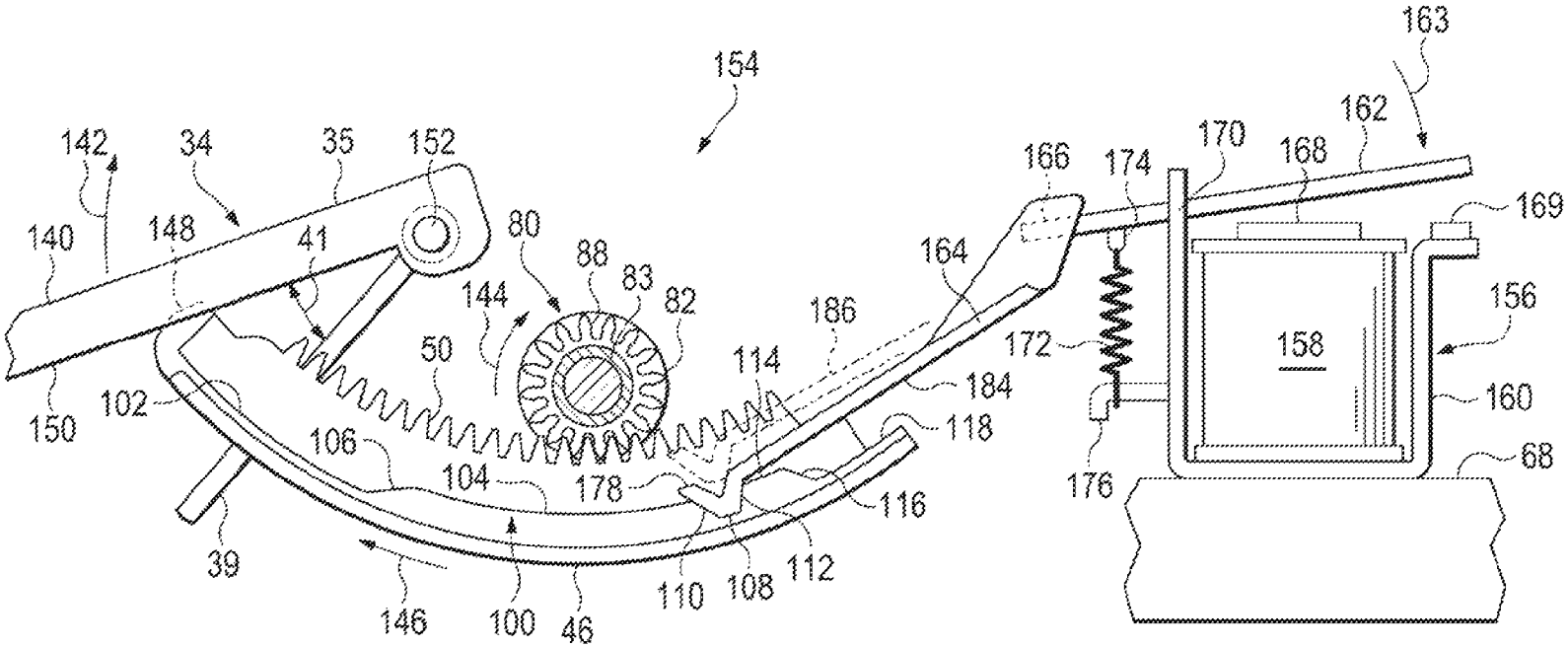
FIG. 11 is another example of a curl control assembly.

An alternative example of a portion of a curl control assembly 154 is shown in FIG. 11. In this example, all the components of curl control assembly 22 and printing device 10 that remain the same for curl control assembly 154 retain the same reference numerals at those used in FIGS. 1-10. Additionally, some components of curl control assembly 154 that are not necessary to illustrate this alternative example have been omitted from FIG. 11 (e.g., support or base 48). A difference between curl control assembly 22 and curl control assembly 154 is actuator or catch assembly 156.

As can be seen in FIG. 11, actuator or catch assembly 156 includes a coil assembly 158 mounted on a frame 160 which in turn is attached to output platen 68. Coil assembly 158 includes a latch 162 that is coupled to arm 164 at end 166. Actuator or catch assembly 156 additionally includes a fulcrum or pivot 170 that is also mounted to frame 160. Latch 162 is pivotally mounted on fulcrum 170, as shown. As can also be seen in FIG. 11, arm 164 is configured to include a follower 178 (in this example having a V-shape) that is designed to ride along profiled region 100, as described above in connection with FIGS. 7-10. A biasing member 172 (e.g., a spring) is coupled to latch 162 on end 174 and to frame 160 on end 176. Biasing member 172 is configured to provide a locking or downward force on latch 162 that secures follower 178 within recessed area or surface 108, as shown.

Coil assembly 158 may be energized, by, for example, processor 24 based on instructions from non-transitory computer-readable storage medium 26, to magnetically attract or pull latch 162 towards contact plate 168 in a direction of arrow 163 which causes latch 162 to pivot about fulcrum 170 until it reaches contact plate 168 and sound damping pad 169. This movement in turn causes arm 164 and follower 178 to lift from the first position 184 to the second position 186. This lifting unlocks gear mechanism or driven gear 46 so that it may further move ejection flap assembly 34, as described above in connection with FIGS. 7-10.

Figure 12:
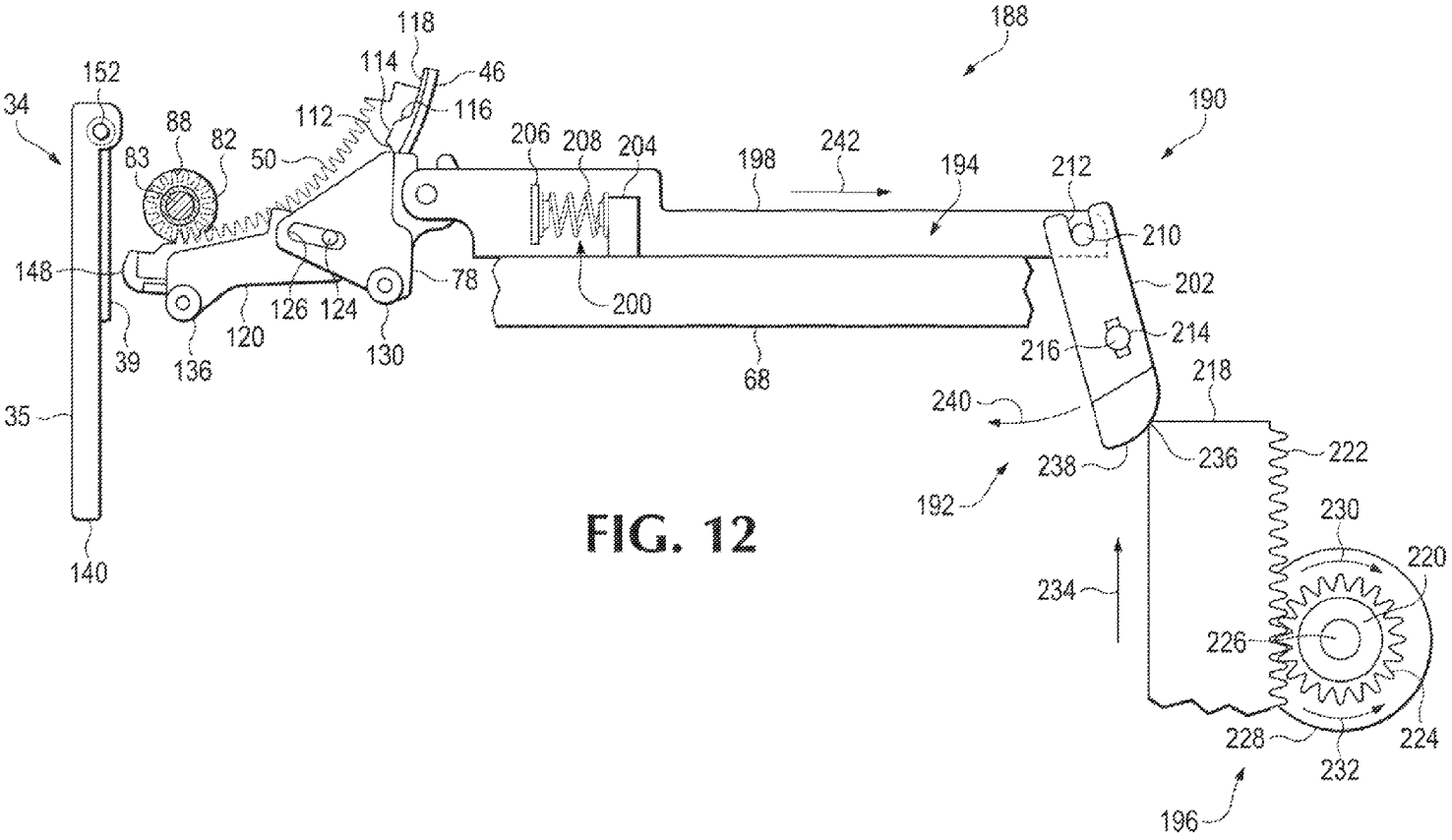
FIG. 12 is yet another example of a curl control assembly.

Another alternative example of a portion of a curl control assembly 188 is shown in FIG. 12. In this example, all the components of curl control assembly 22 and printing device 10 that remain the same for curl control assembly 188 retain the same reference numerals as those used in FIGS. 1-10. Additionally, some components of curl control assembly 188 that are not necessary to illustrate this alternative example have been omitted from FIG. 12 (e.g., support or base 48). A difference between curl control assembly 22 and curl control assembly 188 is actuator or catch assembly 190.

As can be seen in FIG. 12, actuator or catch assembly 190 includes a geared linkage assembly 192. Geared linkage assembly 192 includes a linkage mechanism 194 and a rack and pinion mechanism 196. Linkage mechanism 194 includes a link 198 slidably mounted on output platen 68, a biasing assembly 200 and flag 202. Biasing assembly 200 includes a mount 204 attached to output platen 68 and a mount 206 attached to link 198. Biasing assembly 200 additionally includes a biasing member 208 (in this example a spring) coupled to mounts 204 and 206. Flag 202 is rotatably coupled to link 198 via a pin 210 disposed in slot 212 of flag 202 and an opening (not shown) in link 198. Flag 202 is also rotatably coupled at point 214 via pin 216 which is attached to printing device 10 (not shown in FIG. 12).

Rack and pinion mechanism 196 includes a geared rack 218 and a pinion gear 220. As can also be in FIG. 12, geared rack 218 is configured to include a plurality of teeth 222 having a predetermined pitch. Pinion gear 220 is also configured to include a plurality of teeth 224 having a predetermined pitch that are designed to mesh with teeth 222 of geared rack 218. As can further be seen in FIG. 12, pinion gear 220 is mounted on shaft or rod 226 of motor 228 and can be driven by it in either a clockwise or counterclockwise direction, as indicated by respective arrows 230 and 232.

Motor 228 may be activated, by, for example, processor 24 based on instructions from non-transitory computer-readable storage medium 20, to rotate shaft or rod 226 in the direction of arrow 230 which in turn causes pinion gear 220 to also rotate in this direction. As pinion gear 220 rotates in the direction of arrow 230, teeth 224 mesh with teeth 222 which moves geared rack 218 in the direction indicated by arrow 234. Movement of geared rack 218 causes its end 236 to contact rounded end 238 of flag 202. This contact causes flag 202 to pivot about pin 216, as indicated by arrow 240. This movement in turn causes link 198 to move in the direction of arrow 242 compressing biasing member 208 and causing first member 78 to pivot about boss 130 which moves pin 124 in slot 126. This in turn causes second member 120 to lift follower 122 (not shown in FIG. 12) to the unlatched or unlocked position. This lifting unlocks gear mechanism or driven gear 46 so that it may further move ejection flap assembly 34, as described above in connection with FIGS. 7-10.

Figure 13:
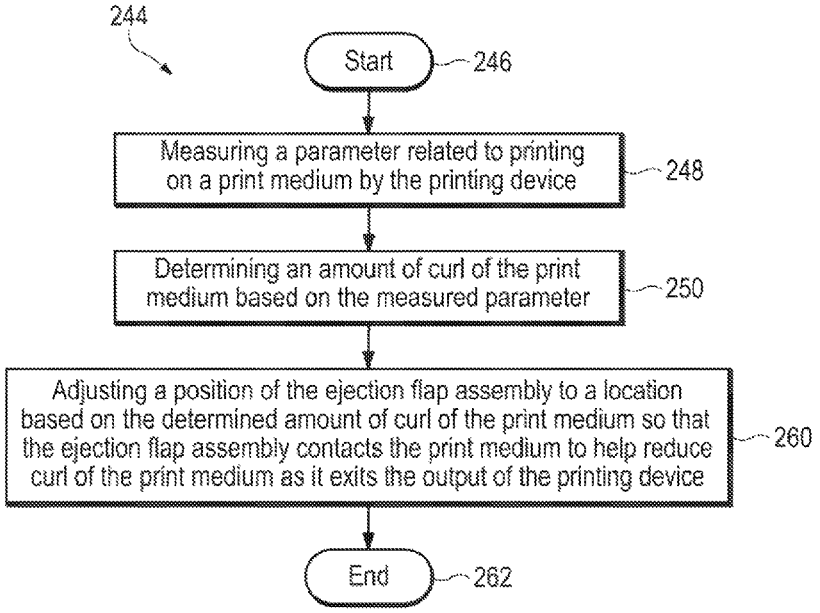
FIG. 13 is an example of a curl control method.

An example of a curl control method 244 for use in a printing device is illustrated in FIG. 13. The printing device is configured to include an output, an ejection flap assembly adjacent the output, and a transport assembly configured to move print media to the output. As can be seen in FIG. 13, method 244 begins 246 by measuring a parameter related to printing on a print medium by the printing device, as indicated by block 248, and determining an amount of curl of the print medium based on the measured parameter, as indicated by block 250. Next, method 244 continues by adjusting a position of the ejection flap assembly to a location based on the determined amount of curl of the print medium so that the ejection flap assembly contacts the print medium to help reduce curl of the print medium as it exits the output of the printing device, as indicated, by block 260. Method 244 may then end 282.

Figure 14:
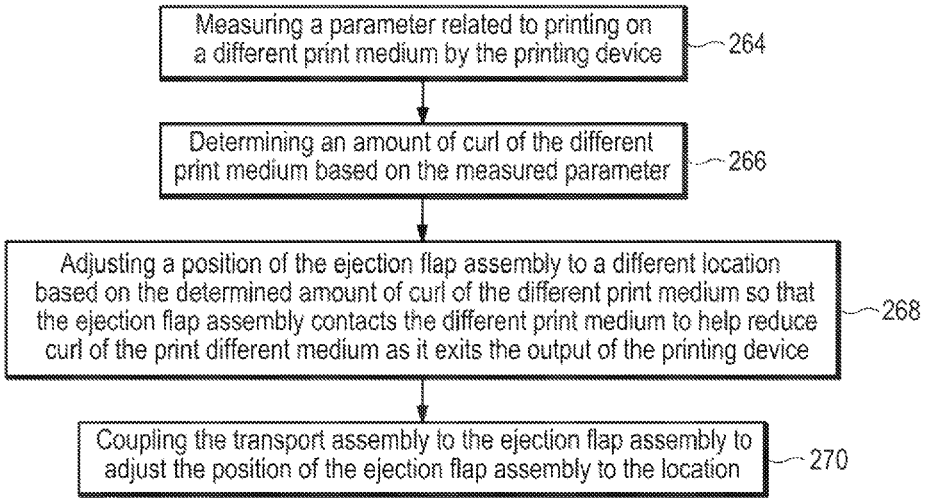
FIG. 14 illustrates additional potential elements of the curl control method of FIG. 13.

Alternatively, rather than ending, method 244 may continue by measuring a parameter related to printing on a different print medium by the printing device, as indicated by block 264 of FIG. 14, and determining an amount of curl of the different print medium based on the measured parameter, as indicated by block 266. The measured parameter includes at least one of the following: a dimension of the print medium, a finish of the print medium, an ambient condition, a percentage of coverage of a printing composition on the print medium, a chemistry of the printing composition, a throughput speed of the printing device, a duplexing of the print medium, and a finishing applied to the print medium.

Method 244 may then continue by adjusting a position of the ejection flap assembly to a different location based on the determined amount of curl of the different print medium so that the ejection flap assembly contacts the different print medium to help reduce curl of the different print medium as it exits the output of the printing device, as indicated by block 268. Method 244 additionally may then continue by coupling the transport assembly to the ejection flap assembly to adjust the position of the ejection flap assembly to the location, as indicated by block 270.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. For example, curl control assembly 22 can be configured to have more than the two curl control positions as shown in FIGS. 8 and 9. As another example, gear mechanism or driven gear 46 of curl control assembly 22 can be configured to have one or more different attributes of profiled region 100 than those illustrated above. As a further example, other followers may be configured to have shapes other than as illustrated above for followers 122 and 178. The spirit and scope of the present invention are to be limited only by the terms of the following claims.

Additionally, reference to an element in the singular is not intended to mean one and only one, unless explicitly so stated, but rather means one or more. Moreover, no element or component is intended to be dedicated to the public regardless of whether the element or component is explicitly recited in the following claims.

What is claimed is:

1. A curl control assembly for use in a printing device having an output for printed media, comprising:

an ejection flap assembly configured to include a hinged door to deflect through an arc and adjacent the output of the printing device and configured to controllably assume a first predetermined position designed to help control a first amount of curl of the printed media as the printed media exits the output of the printing device and a second predetermined position designed to help control a second amount of curl of the printed media as the printed media exits the output of the printing device;

a positioning assembly adjacent the ejection flap assembly and configured to selectively position the ejection flap assembly in one of the first predetermined position and the second predetermined position; and an actuator coupled to the positioning assembly and configured to have both a latched state that helps prevent movement of the positioning assembly and an unlatched state that permits movement of the positioning assembly.

2. The curl control assembly of claim 1, further comprising a processor coupled to the actuator and configured to control the actuator to operate the positioning assembly to selectively position the ejection flap assembly in one of the first predetermined position and the second predetermined position.

3. The curl control assembly of claim 2, wherein the processor determines an optimal one of the first predetermined position and the second predetermined position based on one a plurality of parameters affecting the amount of curl of the printed media including a dimension of the printed media, a finish of the printed media, an ambient condition, a percentage of coverage of a printing composition on the printed media, a chemistry of the printing composition, a printed media throughput speed of the printing device, a duplexing of the printed media, and a finishing applied to the printed media.

4. The curl control assembly of claim 1, wherein the ejection flap assembly is configured to include a main flap and a mini-flap coupled to the main flap and the mini-flap configured to act as a tamper which falls onto the printed media as the printed media exits to the output of the printing device.

5. The curl control assembly of claim 1, wherein the ejection flap assembly is configured to include a main flap and a mini-flap coupled to the main flap and configured to depend from the main flap at a predetermined angle.

6. The curl control assembly of claim 5, wherein the predetermined angle is approximately thirty degrees (30°).

7. The curl control assembly of claim 1, wherein the positioning assembly is configured to include a gear mechanism.

8. The curl control assembly of claim 7, wherein the actuator is configured to include a linkage mechanism coupled to the gear mechanism.

9. The curl control assembly of claim 7, wherein the actuator is configured to include a lever coupled to the gear mechanism.

10. The curl control assembly of claim 1, wherein the actuator includes one of a linear operating device, a solenoid, a coil assembly, and a geared linkage assembly.

11. A printing device, comprising:

a printing assembly configured to place images on print media;

a transport assembly configured to move the print media from the printing assembly to an output;

a curl control assembly adjacent the output and configured to selectively contact the print media at a predetermined position as the print media travels through the output; and a processor coupled to the curl control assembly and configured to determine an amount of curl of the print media and adjust the curl control assembly to contact the print media at the predetermined position based on the determined amount of curl of the print media.

12. The printing device of claim 11, wherein the processor determines the amount of curl of the print media based on one a plurality of parameters including a dimension of the print media, a finish of the print media, an ambient condition, a percentage of coverage of a printing composition on the print media, a chemistry of the printing composition, a throughput speed of the printing device, a duplexing of the print media, and a finishing applied to the print media.

13. The printing device of claim 11, further comprising a non-transitory computer-readable storage medium storing instructions that, when executed by the processor, cause the processor to determine the amount of curl of the print media and adjust the curl control assembly to contact the print media at the predetermined position based on the determined amount of curl of the print media.

14. The printing device of claim 11, wherein the transport assembly is coupled to the curl control assembly and is configured to drive the curl control assembly.

15. The printing device of claim 11, further comprising a clutch assembly configured to couple the curl control assembly to the transport assembly to drive the curl control assembly.

16. The printing device of claim 15, wherein the clutch assembly is configured to include a moveable drive gear coupled to the transport assembly and configured to mesh with a driven gear of the curl control assembly.

17. The printing device of claim 11, wherein the curl control assembly is configured to include a catch assembly having a first position that locks the curl control assembly and a second position that unlocks the curl control assembly.

18. The printing device of claim 17, wherein the catch assembly includes one of a linear operating device, a solenoid, a coil assembly, and a geared linkage assembly.

19. The printing device of claim 11, wherein the curl control assembly is configured to include a plurality of flaps.

20. A curl control method for use in a printing device having an output, an ejection flap assembly adjacent the output, and a transport assembly configured to move print media to the output, comprising:

measuring a parameter related to printing on a print medium by the printing device;

determining an amount of curl of the print medium based on the measured parameter; and selectively adjusting a position of the ejection flap assembly over more than two various predetermined positions to a location based on the determined amount of curl of the print medium so that the ejection flap assembly contacts the print medium to help reduce curl of the print medium as it exits the output of the printing device.

21. The curl control method of claim 20, further comprising:

measuring a parameter related to printing on a different print medium by the printing device;

determining an amount of curl of the different print medium based on the measured parameter; and adjusting the position of the ejection flap assembly to a different location based on the determined amount of curl of the different print medium so that the ejection flap assembly contacts the different print medium to help reduce curl of the different print medium as it exits the output of the printing device.

22. The curl control method of claim 20, wherein the measured parameter includes at least one of the following: a dimension of the print medium, a finish of the print medium, an ambient condition, a percentage of coverage of a printing composition on the print medium, a chemistry of the printing composition, a throughput speed of the printing device, a duplexing of the print medium, and a finishing applied to the print medium.

23. The curl control method of claim 20, further comprising coupling the transport assembly to the ejection flap assembly to adjust the position of the ejection flap assembly to the location.

* * * * *